US006762781B2

(12) United States Patent
Kojima et al.

(10) Patent No.: US 6,762,781 B2
(45) Date of Patent: Jul. 13, 2004

(54) IMAGE RECORDING METHOD AND APPARATUS

(75) Inventors: Tetsuya Kojima, Kanagawa (JP); Masayuki Kawata, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 16 days.

(21) Appl. No.: 09/988,669

(22) Filed: Nov. 20, 2001

(65) Prior Publication Data

US 2002/0060730 A1 May 23, 2002

(30) Foreign Application Priority Data

Nov. 20, 2000 (JP) ..... 2000-352673

(51) Int. Cl.[7] ..... B41J 2/355
(52) U.S. Cl. ..... 347/183; 400/120.07
(58) Field of Search ..... 358/3.06–3.2, 358/1.9, 503, 521, 523; 347/183, 171–172, 211, 180, 185, 184, 188, 189; 400/120.07, 120.09; 382/169

(56) References Cited

U.S. PATENT DOCUMENTS 6,034,707 A 3/2000 Agano
6,222,572 B1 * 4/2001 Kurachi ..... 347/184

FOREIGN PATENT DOCUMENTS

JP 07-096625 A 4/1995
JP 10-44509 A 2/1998

* cited by examiner

*Primary Examiner*—K. Feggins
(74) *Attorney, Agent, or Firm*—Sughrue Mion, PLLC

(57) ABSTRACT

This invention relates to an image recording method of recording a single pixel forming an image using a plurality of pulses by expressing gradation using a single pulse or a plurality of pulses having a larger pulse width expressing a superordination bit and a single pulse or a plurality of pulses having a smaller pulse width expressing a subordination bit, and an image recoding apparatus for carrying out the method and the like.

18 Claims, 7 Drawing Sheets

FIG.4(TABLE 1)

| |
|---|
| "width 32" × 127 + "width 16" + "width 8" + "width 4" + "width 2" + "width 1"<br>(132 steps of dispersion, 132 pulse transfers) |
| "width 16" × 225 + "width 8" + "width 4" + "width 2" + "width 1"<br>(259 steps of dispersion, 259 pulse transfers) |
| "width 8" × 511 + "width 4" + "width 2" + "width 1"<br>(514 steps of dispersion, 514 pulse transfers) |

FIG. 5 (TABLE 2)
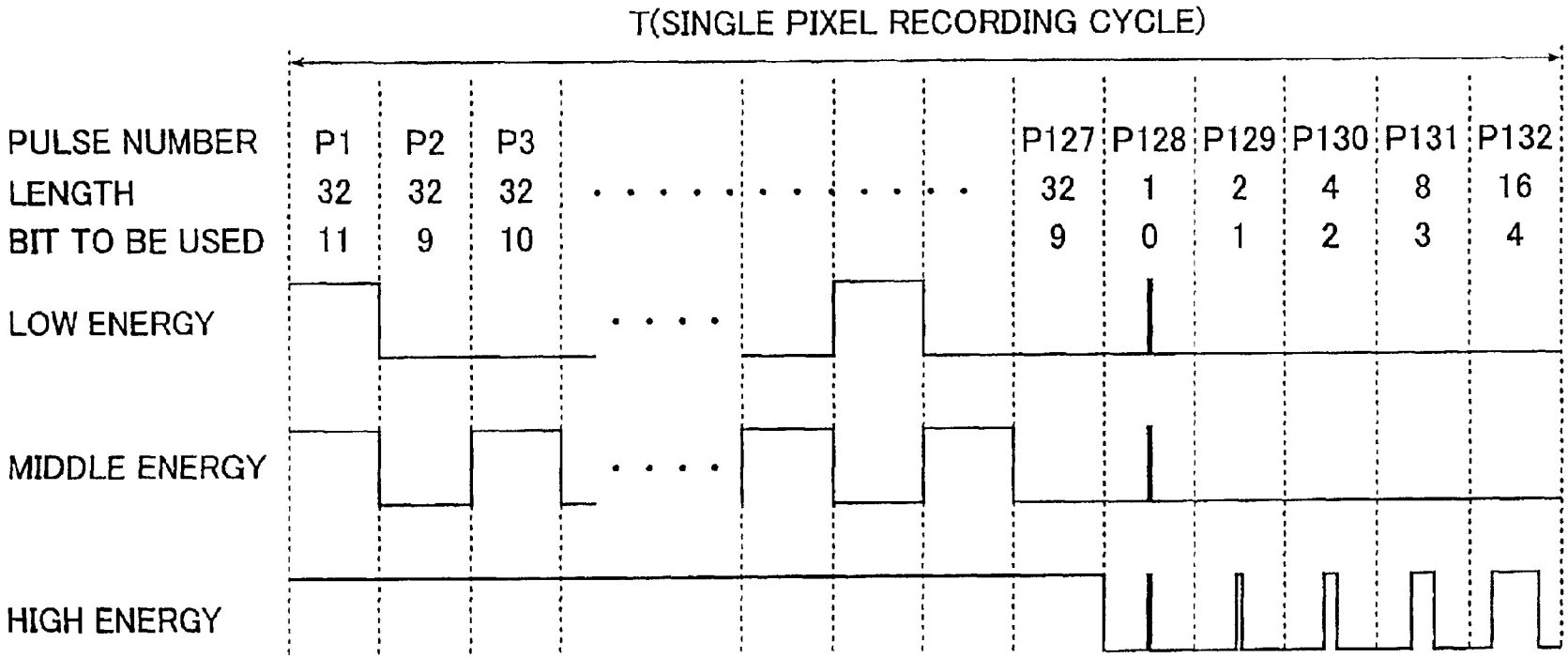

FIG.6(TABLE 3)

BIT TO BE USED : 0~11 DATA LEVEL 1027

| DISPERSION | PIXEL POSITION(0~191) | | | | | | | | | | | | | | | | | | | |
|---|---|---|---|---|---|---|---|---|---|---|---|---|---|---|---|---|---|---|---|---|
| | 0 | 1 | 2 | 3 | 4 | 5 | 6 | 7 | 8 | 9 | 10 | | 184 | 185 | 186 | 187 | 188 | 189 | 190 | 191 |
| 0 | 11 | 8 | 11 | 10 | 11 | 9 | 11 | 10 | 11 | 5 | 11 | | 10 | 11 | 9 | 11 | 10 | 11 | 8 | 11 |
| 1 | 10 | 11 | 7 | 11 | 10 | 11 | 9 | 11 | 10 | 11 | 8 | | 11 | 10 | 11 | 9 | 11 | 10 | 11 | 5 |
| 2 | 11 | 10 | 11 | 8 | 11 | 10 | 11 | 9 | 11 | 10 | 11 | | 7 | 11 | 10 | 11 | 9 | 11 | 10 | 11 |
| 3 | 9 | 11 | 10 | 11 | 6 | 11 | 10 | 11 | 9 | 11 | 10 | | 11 | 8 | 11 | 10 | 11 | 9 | 11 | 10 |
| 4 | 11 | 9 | 11 | 10 | 11 | 8 | 11 | 10 | 11 | 9 | 11 | | 10 | 11 | 6 | 11 | 10 | 11 | 9 | 11 |
| 5 | 10 | 11 | 8 | 11 | 10 | 11 | 7 | 11 | 10 | 11 | 9 | | 11 | 10 | 11 | 8 | 11 | 10 | 11 | 9 |
| 6 | 11 | 10 | 11 | 9 | 11 | 10 | 11 | 8 | 11 | 10 | 11 | . . . | 9 | 11 | 10 | 11 | 7 | 11 | 10 | 11 |
| 7 | 8 | 11 | 10 | 11 | 9 | 11 | 10 | 11 | 5 | 11 | 10 | | 11 | 9 | 11 | 10 | 11 | 8 | 11 | 10 |
| 8 | 11 | 7 | 11 | 10 | 11 | 9 | 11 | 10 | 11 | 8 | 11 | | 10 | 11 | 9 | 11 | 10 | 11 | 5 | 11 |
| 9 | 10 | 11 | 8 | 11 | 10 | 11 | 9 | 11 | 10 | 11 | 7 | | 11 | 10 | 11 | 9 | 11 | 10 | 11 | 8 |
| 10 | 11 | 10 | 11 | 6 | 11 | 10 | 11 | 9 | 11 | 10 | 11 | | 8 | 11 | 10 | 11 | 9 | 11 | 10 | 11 |
| 11 | 8 | 11 | 10 | 11 | 8 | 11 | 10 | 11 | 9 | 11 | 10 | | 11 | 6 | 11 | 10 | 11 | 9 | 11 | 10 |
| ⋮ | | | | | . . . | | | | | | | | | | | . . . | | | | |
| 125 | 10 | 10 | 11 | 9 | 11 | 10 | 11 | 7 | 11 | 10 | 11 | | 9 | 11 | 10 | 11 | 8 | 11 | 10 | 11 |
| 126 | 11 | 11 | 10 | 11 | 9 | 11 | 10 | 11 | 8 | 11 | 10 | | 11 | 9 | 11 | 10 | 11 | 7 | 11 | 10 |
| 127 | 0 | 0 | 0 | 0 | 0 | 0 | 0 | 0 | 0 | 0 | 0 | | 0 | 0 | 0 | 0 | 0 | 0 | 0 | 0 |
| 128 | 1 | 1 | 1 | 1 | 1 | 1 | 1 | 1 | 1 | 1 | 1 | | 1 | 1 | 1 | 1 | 1 | 1 | 1 | 1 |
| 129 | 2 | 2 | 2 | 2 | 2 | 2 | 2 | 2 | 2 | 2 | 2 | | 2 | 2 | 2 | 2 | 2 | 2 | 2 | 2 |
| 130 | 3 | 3 | 3 | 3 | 3 | 3 | 3 | 3 | 3 | 3 | 3 | | 3 | 3 | 3 | 3 | 3 | 3 | 3 | 3 |
| 131 | 4 | 4 | 4 | 4 | 4 | 4 | 4 | 4 | 4 | 4 | 4 | | 4 | 4 | 4 | 4 | 4 | 4 | 4 | 4 |

FIG.7(TABLE 4)

132 DISPERSION 16×127+1+2+4+8

DATA LEVEL 1027

| DISPERSION NUMBER OF DATA TO BE RECORDED (0～131) | PULSE WIDTH | PIXEL POSITION (0～191) | | | | | | | | | | | | | | | | | | | NUMBER OF ON-PULSES AT EACH TIME |
|---|---|---|---|---|---|---|---|---|---|---|---|---|---|---|---|---|---|---|---|---|---|
| | | COMMAND VALUE | 0 | 1 | 2 | 3 | 4 | 5 | 6 | 7 | 8 | 9 | 10 | | 185 | 186 | 187 | 188 | 189 | 190 | 191 | |
| | | | 1027 | 1027 | 1027 | 1027 | 1027 | 1027 | 1027 | 1027 | 1027 | 1027 | 1027 | | 1027 | 1027 | 1027 | 1027 | 1027 | 1027 | 1027 | |
| 0 | 32 | | 0 | 0 | 0 | 32 | 0 | 0 | 0 | 32 | 0 | 0 | 0 | | 0 | 0 | 0 | 32 | 0 | 0 | 0 | 49 |
| 1 | 32 | | 32 | 0 | 0 | 0 | 32 | 0 | 0 | 0 | 32 | 0 | 0 | | 32 | 0 | 0 | 0 | 32 | 0 | 0 | 48 |
| 2 | 32 | | 0 | 32 | 0 | 0 | 0 | 32 | 0 | 0 | 0 | 32 | 0 | | 0 | 32 | 0 | 0 | 0 | 32 | 0 | 48 |
| 3 | 32 | | 0 | 0 | 32 | 0 | 0 | 0 | 32 | 0 | 0 | 0 | 32 | | 0 | 0 | 32 | 0 | 0 | 0 | 32 | 49 |
| 4 | 32 | | 0 | 0 | 0 | 32 | 0 | 0 | 0 | 32 | 0 | 0 | 0 | | 0 | 0 | 0 | 32 | 0 | 0 | 0 | 49 |
| 5 | 32 | | 32 | 0 | 0 | 0 | 32 | 0 | 0 | 0 | 32 | 0 | 0 | ... | 32 | 0 | 0 | 0 | 32 | 0 | 0 | 47 |
| 6 | 32 | | 0 | 32 | 0 | 0 | 0 | 32 | 0 | 0 | 0 | 32 | 0 | | 0 | 32 | 0 | 0 | 0 | 32 | 0 | 49 |
| 7 | 32 | | 0 | 0 | 32 | 0 | 0 | 0 | 32 | 0 | 0 | 0 | 32 | | 0 | 0 | 32 | 0 | 0 | 0 | 32 | 49 |
| 8 | 32 | | 0 | 0 | 0 | 32 | 0 | 0 | 0 | 32 | 0 | 0 | 0 | | 0 | 0 | 0 | 32 | 0 | 0 | 0 | 48 |
| 9 | 32 | | 32 | 0 | 0 | 0 | 32 | 0 | 0 | 0 | 32 | 0 | 0 | | 32 | 0 | 0 | 0 | 32 | 0 | 0 | 48 |
| 10 | 32 | | 0 | 32 | 0 | 0 | 0 | 32 | 0 | 0 | 0 | 32 | 0 | | 0 | 32 | 0 | 0 | 0 | 32 | 0 | 49 |
| 11 | 32 | | 0 | 0 | 32 | 0 | 0 | 0 | 32 | 0 | 0 | 0 | 32 | | 0 | 0 | 32 | 0 | 0 | 0 | 32 | 49 |
| ⋮ | ⋮ | | | | | | ... | | | | | | | | | | ... | | | | | ⋮ |
| 125 | 32 | | 32 | 32 | 0 | 0 | 0 | 32 | 0 | 0 | 0 | 32 | 0 | | 0 | 32 | 0 | 0 | 0 | 32 | 0 | 48 |
| 126 | 32 | | 0 | 0 | 32 | 0 | 0 | 0 | 32 | 0 | 0 | 0 | 32 | | 0 | 0 | 32 | 0 | 0 | 0 | 32 | 49 |
| 127 | 1 | | 1 | 1 | 1 | 1 | 1 | 1 | 1 | 1 | 1 | 1 | 1 | | 1 | 1 | 1 | 1 | 1 | 1 | 1 | 193 |
| 128 | 2 | | 2 | 2 | 2 | 2 | 2 | 2 | 2 | 2 | 2 | 2 | 2 | | 2 | 2 | 2 | 2 | 2 | 2 | 2 | 193 |
| 129 | 4 | | 0 | 0 | 0 | 0 | 0 | 0 | 0 | 0 | 0 | 0 | 0 | | 0 | 0 | 0 | 0 | 0 | 0 | 0 | 0 |
| 130 | 8 | | 0 | 0 | 0 | 0 | 0 | 0 | 0 | 0 | 0 | 0 | 0 | | 0 | 0 | 0 | 0 | 0 | 0 | 0 | 0 |
| 131 | 16 | | 0 | 0 | 0 | 0 | 0 | 0 | 0 | 0 | 0 | 0 | 0 | | 0 | 0 | 0 | 0 | 0 | 0 | 0 | 0 |

IMAGE RECORDING METHOD AND APPARATUS

BACKGROUND OF THE INVENTION

1. Field of the Invention

The present invention relates to an image recording method and an image recording apparatus, and more especially to an image recording method and an image recoding apparatus for, e.g., an apparatus for performing main-scanning of a recording medium to be sub-scanned and transferred, and then recording an image, in which the image is dispersion-recorded in a direction of sub-scanning.

2. Description of the Related Art

Conventionally, an image recording apparatus using a thermal head to record an image on a recording medium, has widely been used. Image recording apparatus like this, a thermal recording material, which is used for the recording medium, is pressed onto a line-type thermal head on which a plurality of heating elements are arranged in one-dimensional direction. While the heating elements are being controlled respectively in response to image data, the thermal recording material is transferred in a direction perpendicular to the one-dimensional direction, resulting in recording a desired two-dimensional gradation image.

In this case, the gradation image is formed as shown in FIG. 3A. Namely, the image of gradation D=1 is formed by activating the heating element or elements for t [seconds]. Further, the image of gradation D=2 is formed by activating the heating elements for 2t [seconds]. Further, the images of gradation D=3 to D=5 are formed by activating the heating elements for 3t to 5t [seconds], respectively.

Thus, pixels having different light-emission areas in accordance with gradation are formed on the thermal recording medium within a single pixel width in the transferring direction, as shown in FIG. 3B. Thereby, a gradation image is recorded. In the above example, a case of modulation of the pulse width has been described. However, even in a case of modulation of a number of pulses, a gradation image is recorded in substantially the same manner as in a case of modulation of the pulse width as above.

Incidentally, when a gradation image is recorded like this, each pixel is always recorded from a constant point (point "a" in FIG. 3B). Since the point "b" side in a single pixel width in the transferring direction becomes no-recorded portion, the recorded image becomes concentrated on the point "a" side as above. Therefore, when a formed two-dimensional image is viewed over its entirety, there occurs a drawback that the image becomes conspicuously coarse.

In order to overcome this drawback, it is effective to dispersion-record the image data. Various types of technologies therefor have been proposed. For example, the technology of "Image Recording Method and Apparatus" disclosed in JP 07-96625 A corresponded to an application made by the assignee for the present invention also can be given as one example of such a technology.

According to this technology, when the image is one-dimensionally recorded along in a one-dimension direction on the recording medium using an image recording unit, and either the recording medium or the image recording unit is moved in a direction perpendicular to the one-dimensional direction to record the image, and simultaneously, the multi-gradation image data of each of pixels constituting the image are divided into a plurality of substantially equal portions of image data. Based on this plurality of divided image data, the image is dispersed in a direction in which the recording medium or the image recording unit, is moved and thus recorded.

According to this technology, the image data of each of the pixels constituting the image is divided into a plurality of substantially equal portions of image data. Based on the divided image data, the image is dispersed in a direction in which the recording medium or the image recording unit is moved thereby recording the image. This produces the result that the roughness occurred in recording the two-dimensional gradation image disappears, and it becomes possible to record an image with high image quality.

Further, in a technology of "Image Recording Method" disclosed in JP 10-44509 A corresponded to an application which was also filed by the same assignee for the present application, an image is recorded using an image recording unit in a one-dimensional manner onto a recording medium, and also, either the recording medium or the image recording unit is moved in a direction perpendicular to the one-dimensional direction to record the image, and multi-gradation image data of the image elements constituting the image are divided into a plurality of number of substantially equal portions of image data. This image data is allotted to a part of the recording points divided by a number of the image data or more. Then, the image is dispersed in the moving direction in which the recording unit or the image recording unit is moved thereby recording the image.

According to this technology, it becomes possible to prevent deterioration such fuzziness of the image quality in the low density areas, in which there has been a possibility of such deterioration occurring in the technology discussed above, and this makes it possible to apply the image dispersion-recording method more effectively.

However, recently, an image to be recorded has been formed by higher steps of gradation than ever. For example, 4,096 steps of gradation form a 12-bit-image. Accompanying with such an improvement, when a thermal recording is performed using the dispersion-recording technology, a further problem has occurred that a number of data-transfer is being increased.

SUMMARY OF THE INVENTION

The present invention is developed in view of the above-mentioned problem. The invention has an object to provide an image recording method and apparatus capable of overcoming the problem owing to that the number of data-transfer has been increased when an image is formed using higher steps of gradation in the above-mentioned dispersion-recording technology.

One aspect of an image recording method relating to the present invention is characterized in that the image recording method of recording a single pixel forming an image using a plurality of pulses comprises the step of expressing gradation using a single pulse or a plurality of pulses expressing a superordination bit having larger pulse width and a single pulse or a plurality of pulses expressing a subordination bit having smaller pulse width.

It is further preferable the image recording method in which the plurality of pulses at irregular intervals are applied to the single pixel. Additionally, the plurality of pulses at irregular intervals are applied to not only the single pixel but also neighboring pixels.

Further aspect of an image recording method relating to the present invention is characterized by having activation (ON-status) or non-activation (OFF-status) for each of the pulses, related to a specified bit forming image data.

Further aspect of an image recording method relating to the present invention is characterized by expressing gradation using a single pulse or a plurality of pulses having a larger pulse width expressing a superordination bit and a single pulse or a plurality of pulses having a smaller pulse width expressing a subordination bit and having activation or non-activation operation for each of the pulses, related to a specified bit forming image data.

One aspect of an image recording apparatus relating to the present invention is characterized by having an image recording unit which records an image in a first direction; a transfer unit which relatively transfers said image recording unit and a recording medium in a second direction normal to said first direction; and a record control unit which controls and records a single pixel using a plurality of pulses when the image is recorded, the record control unit expressing gradation for the image to be recorded using one pulse or more each whose pulse width is greater expressing a superordination bit and whose pulse width is smaller expressing a subordination bit.

Further aspect of the image recording apparatus relating to the present invention is characterized in that the plurality of pulses at irregular intervals are applied to the single pixel. Additionally, the plurality of pulses at irregular intervals are applied to not only the single pixel but also neighboring pixels.

Further aspect of the image recording apparatus relating to the present invention is characterized by having an image recording unit which records an image in a first direction; a transfer unit which relatively transfers the image recording unit and a recording medium in a second direction normal to the first direction; and a record control unit which controls and records a single pixel using a plurality of pulses when the image is recorded, the record control unit having activation (ON) or non-activation (OFF) operation for each of the pulses, related to a specified bit forming image data.

Further aspect of the image recording apparatus relating to the present invention is characterized by having an image recording unit which records an image in a first direction; a transfer unit which relatively transfers the image recording unit and a recording medium in a second direction normal to the first direction; and a record control unit which controls and records a single pixel using a plurality of pulses when the image is recorded, the record control unit expressing gradation for the image to be recorded using a single pulse or a plurality of pulses having a larger pulse width expressing a superordination bit and a single pulse or a plurality of pulses having a smaller pulse width expressing a subordination bit and having activation or non-activation operation for each of the pulses, related to a specified bit forming image data.

Additionally, the above image recording apparatus includes a thermal head.

BRIEF DESCRIPTION OF THE DRAWINGS

In the accompanying drawings:

FIG. 1A is a timing chart according to a conventional art, and FIG. 1B is a timing chart according to the embodiment of the present embodiment;

FIG. 3A is an explanatory diagram of a drive signal, and FIG. 3B is an explanatory diagram of an image formed thereby.

FIG. 4 shows examples of combination of some pulse widths (Table 1).

FIG. 5 shows an example of correspondences for forming a basis of a table stored (Table 2).

FIG. 6 shows a table used for designating the bits to be used in the case where a solid image of 1,027 steps of gradation is to be recorded (Table 3).

FIG. 7 shows the width of the pulse (i.e., drive time for activation) when the heating elements on the thermal head are actually driven based on the pulse pattern to be used shown in FIG. 6 (Table 4).

DETAILED DESCRIPTION OF THE PREFERRED EMBODIMENTS

First, brief explanation will be made of an image recording method on the basis of the present invention.

Figure 1A:
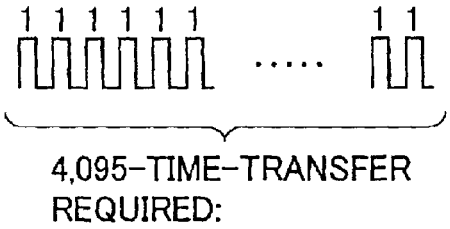
FIGS. 1A and 1B are explanatory diagrams of a construction of an embodiment of an image recording apparatus to which an image recording method is applied, according to the present invention.
Figure 1B:
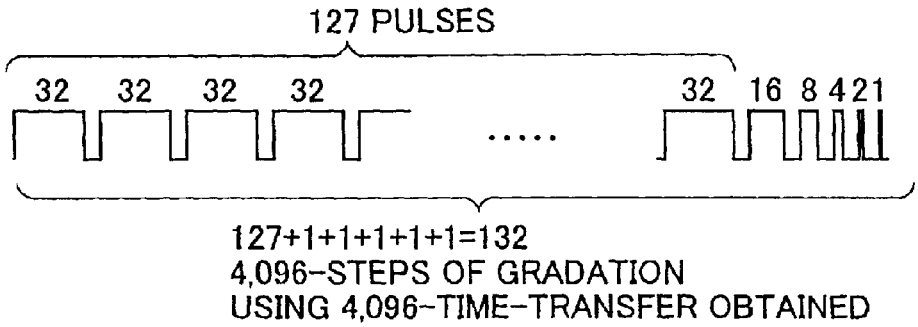

As an example of the method, FIGS. 1A and 1B, respectively show states of dispersion-recording pulses used for a conventional image recording method and the present invention recording method, when recording a 12-bit-image data expressed by 4,096 steps of gradation. According to the conventional image recording method as shown in FIG. 1A, a pulse is transferred by 4,095-times, using 4,095 pulses, each whose width is "1". On the other hand, according to the image recording method of the present invention as shown in FIG. 1B, a pulse having a width of 32 which indicates a pulse having a width corresponded to 32-pulses each whose width is "1" is used as the basis. Fractional widths which cannot be recorded merely by the pulse having the width of 32, e.g., pulses of widths such as 1,2,4,8 and 16 are appropriately combined thereby performing recording. In this example, the numbers of time of the pulse transfer can drastically be changed from 4,095 times to 132 times, so that the numbers of time of the pulse transfer are drastically reduced.

Here, the above-mentioned basic pulse width used for the image recording method forming the basis of the present invention, is not limited by the width of 32. Alternatively, a pulse having a width of 8 or 16 may preferably be used. If a basic pulse width to be used becomes narrower (i.e., smaller), then the numbers of time of the pulse transfer naturally are increased. In even such a case of using the pulse having a width of 8 or 16, the number of times of pulse transfer can be decreased to an incomparable extent against the conventional art. Further, the basic pulse width to be used is made to be narrower (smaller), drawback such as coarseness of an image can be improved.

Optionally, Table 1 shows three examples of combinations of pulse widths. FIG. 4 shows combination of 4,095 numbers of recording pulses when 4,096 steps of gradation are expressed.

Detailed explanation will be made of the embodiment of the present invention, based on a preferred example shown in the accompanying drawings. Note that the above-mentioned technology of "Image Recording Method and Apparatus" disclosed in JP 07-96625 A is referred as a base for the following explanation.

Figure 2:
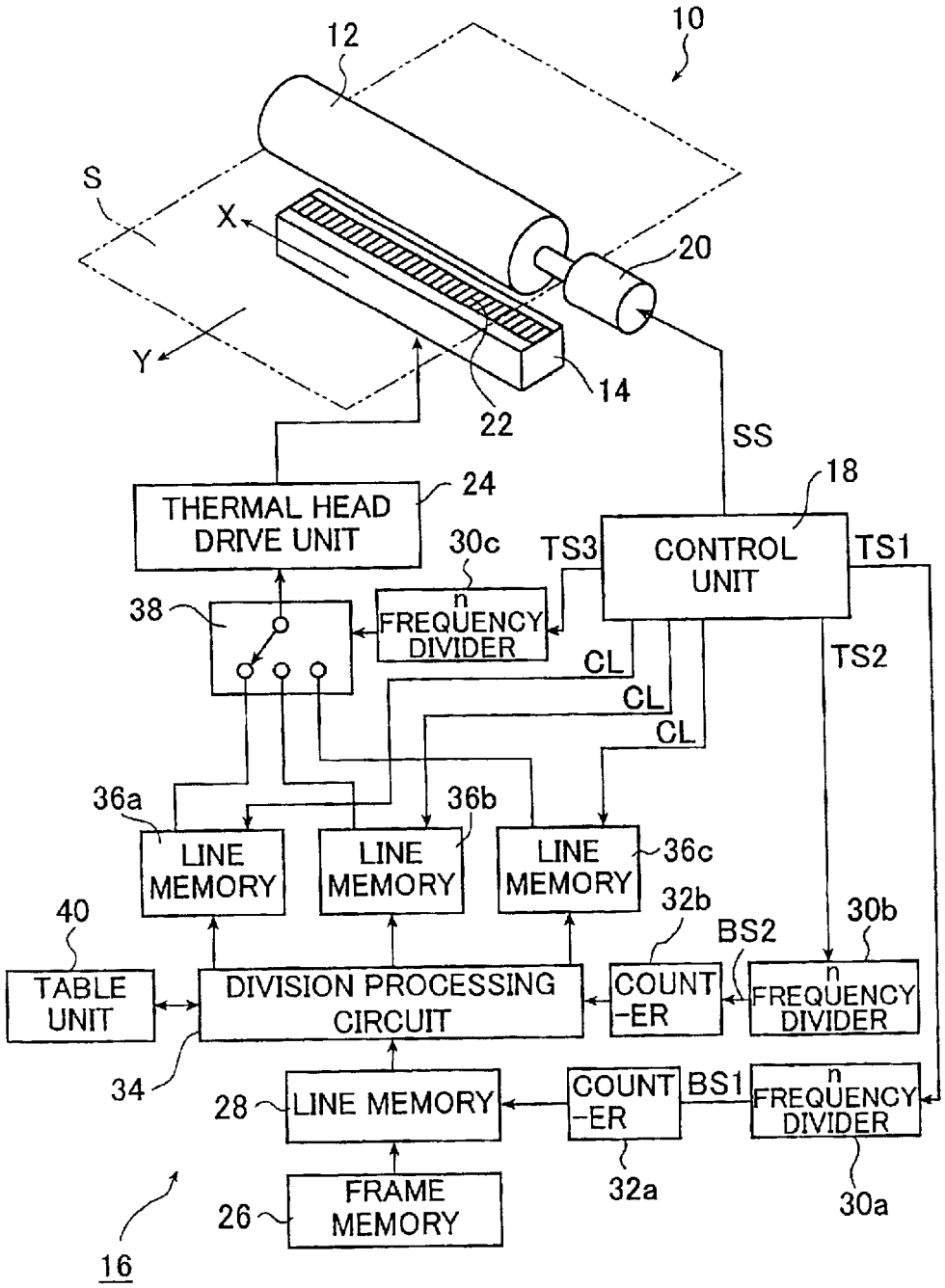
FIG. 2 is an explanatory diagram of the construction of the embodiment of the image recording apparatus to which the image recording method is applied, according to the embodiment of the present invention.
Figure 3A:
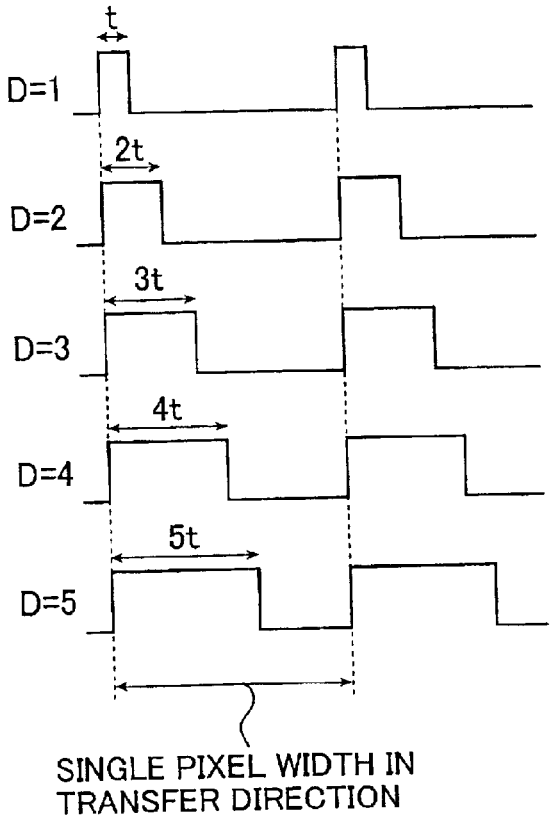
FIGS. 3A and 3B are explanatory diagrams of operation in the case where a conventional pulse width modulation is performed.
Figure 3B:
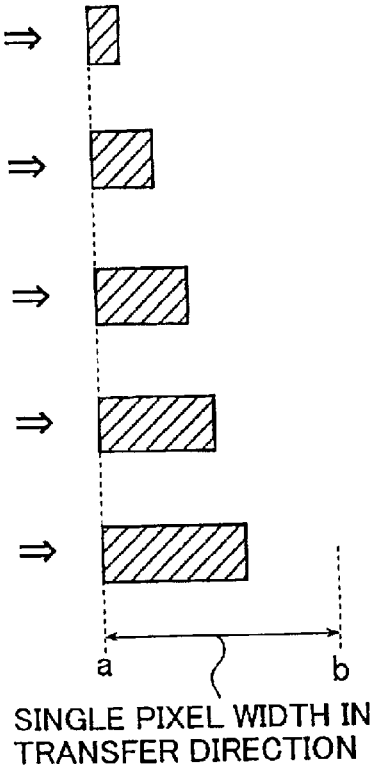

FIG. 2 shows an image recording apparatus 10 using a thermal head relating to the image recording method of the present invention. In the image recording apparatus 10, a sheet-shaped thermal recording material S is sandwiched between a platen roller 12 and the thermal head 14 as an image recording unit. In this state, the material S is transferred in the direction indicated by an arrow Y using the platen roller 12 controlled by an image recording control device 16 for controlling dispersion and recording in the image recording method of the present invention. Further, the thermal head 14 controlled by the image recording control device 16, records a gradation image onto the material S in a one-dimensional direction (i.e., the direction of an arrow X), so that a two-dimensional gradation image is recorded.

The platen roller 12 is rotated using a step motor 20 as a recording medium moving unit under control by a control unit 18 of the image recording control device 16, and thus transfers the thermal recording material S in the direction of the arrow Y. The thermal head 14 is constituted by many heating elements 22 arranged in a one-dimensional direction (i.e., the direction of the arrow X). Each of the heating elements 22 is activated (heated up) using a drive electric current provided from a thermal head drive unit 24 for the image recording control device 16, to emit color(s) in a predetermined gradation with the thermal (heat sensitive) recording material.

Here, the image recording control device 16 is provided with a frame memory 26 which stores image data corresponding to a single page; a line memory 28 which stores two-dimensional image data recorded in the frame memory 26 by each of one-dimensional image data; a divided image data memory, i.e. line memories 36*a*, 36*b* and 36*c* each which stores divided image data in which total image data from which the one-dimensional image data can be obtained, is divided using a below-mentioned method; a thermal head drive unit 24 which drives the thermal head 14 based on the divided image data and recording an image onto the thermal recording material S; and the control unit 18 which controls them.

Conventionally, when so-called division-recording is performed, calculation regarding whether a certain pulse lies in ON-status or OFF-status, has often been performed using a method of comparing image data with a count value. Therefore, when higher steps of gradation are used, an amount of calculation becomes greater and greater as described above. Then, in the image recording method forming the base of the present invention, a one-to-one correspondence is created between a specified bit among the image data and the pulse to be used having a predetermined width. Thereafter the correspondence is made as a table in advance, and the image data can easily be converted into a pulse sequence.

Secondly, the embodiment will be explained, returning now to FIG. 2.

The control unit 18 of the image recording control device 16 provides a predetermined drive signal SS to the step motor 20, and outputs timing signals TS1–TS3 and a read-out clock signals CL corresponded to the drive signal SS. In this case, the control unit 18 serves as a recording position detection unit for detecting a position where the image is recorded using the thermal head 14, based on the above-mentioned timing signals TS1–TS3.

The timing signal TS1 is further provided to an n-frequency divider 30*a*. The n-frequency divider 30*a* provides this timing signal TS1 to the line memory 28 by way of a counter 32*a,* as a divided frequency signal BS1 having a frequency of 1/n. Note that the line memory 28 stores from the frame memory 26. The one-dimensional image data are recorded on the thermal recording material S in the direction of the arrow X in accordance with the divided frequency signal BS1.

Further, the timing signal TS2 is provided to an n-frequency divider 30*b* while following the timing signal TS1 with a delay of one pulse width. The n-frequency divider 30*b* provides the timing signal TS2 to a division processing circuit 34 as a divided frequency signal BS2 having a frequency of 1/n. As described below, the division processing circuit 34 cyclically provides the divided ones as an n-group of one-dimensional image data to line memories (the divided image data recording units) 36*a*, 36*b*, and 36*c*, based on each image data read out from the line memory 28 in accordance with the divided frequency signal BS2, referring to the table stored in a table storing unit 40.

The timing signal TS3 is further provided to a switching device 38 through an n frequency divider 30*c* while following the timing signal TS2 with a delay by a single pulse. This switching device (i.e., image data selection unit) 38 is arranged between the thermal head drive unit 24 and the line memories 36*a*–36*c*, selectively switches among the line memories 36*a*–36*c* according to the timing signal TS3, and connected to the thermal head drive unit 24. Additionally, the read-out clock signal CL is provided from the control unit 18 to the line memories 36*a* to 36*c*.

The image recording apparatus 10 according to this embodiment is basically constituted as above.

Next, explanation will be made of operations thereof, using the example depicted in FIG. 1 of 132 steps of dispersion, namely, n=132.

FIG. 5 (Table 2) shows an example of correspondence (relationship) on the basis of the table stored in the table storing unit 40 mentioned above (i.e., dispersion number to pixel position correspondence table), established between the pulse number and the pulse width, and the bits among the image data corresponded thereto (hereinafter, referred to as bits to be used), in the case of 132 steps of dispersion. Additionally, an energy level is divided into three.

As shown in Table 2, in case of 132 steps of dispersion, the pulses P1, P2, . . . P127 of 132 numbers of pulses of P1, P2, . . . P132 are pulses each having a width of 32, and the subsequent pulses P128, P129, P130, P131 and P132 are pulses having widths of 1, 2, 4, 8 and 16 in order and that they correspond to using bits of 5,6,7,8,9,10, and 11 (i.e., superordination bits for the larger pulse width) and using bits of 0, 1, 2, 3 and 4, (i.e., subordination bits for the smaller pulse width) respectively.

On the basis of data set in Table 2, FIG. 6 (Table 3) shows dispersion-recording order (corresponded to dispersion in a vertical direction in Table 3) in a case of 1,027 steps of gradation. Further, Table 3 is used for designating using bits when a solid image expressed by 1,027 steps of gradation is recorded by a number of the thermal element 22 in a single block on the thermal head 14 (corresponded to a pixel position in a horizontal direction in Table 3). Here, an example is illustrated in which a pulse pattern to be used, is set as random as possible between the pixel positions in the horizontal direction in order to prevent cyclical irregularity when the solid image is recorded.

FIG. 7 (Table 4) shows the width of the pulse (i.e., drive time for activation) when the heating elements 22 on the thermal head 14 are actually driven based on the pulse pattern to be used shown in Table 3. Table 4 is meant by that, when 1,027 steps of gradation are recorded at the 1 step of dispersion, a pulse having a width of 32 is to be used at the pixel positions 0, 4, 8 . . . 185 and 189, and also, at the 127 step of dispersion, a pulse having a width of 1 is to be used for all of the pixel positions of 0 to 191.

The above-mentioned division processing circuit 34 has the table storing unit 40 which stores a table group corresponding to the above-mentioned Table 3 by each of steps of gradation (the recording density) and corresponding to at least a single dispersion pattern. The circuit 34 refers to bit or bits in the image data of each line read from the line memory 28. Then when the bit or the bits which are to be used is/are present in this data, the circuit 34 verifies the bits or bit with a table having the format shown in Table 4. Thus, the bits are converted into a signal that outputs pulse of the predetermined width.

In this embodiment, the result of the verification in the division processing circuit 34 as above-mentioned is cyclically output to the three line-memories 36*a*, 36*b* and 36*c*. However, it is not necessary to limit by only this method. Further, each of the tables is merely shown as an example. Any method other than them may be adopted.

Next, explanation will be made of operation of the image recording apparatus according to this embodiment constituted as above-mentioned.

First, the control unit 18 outputs the drive signal SS to the step motor 20. The step motor 20 rotates the platen roller 12 based on this drive signal SS. The thermal recording material S is transferred in the direction of the arrow Y at a predetermined speed. On the other hand, the control unit 18 generates timing signals TS1–TS3 being synchronized or proportionate to the drive signal SS, and these signals TS1–TS3 are outputted to the n-frequency dividers 30*a* and 30*b* and to the switching device 38. Further, the n-frequency divider 30*a* divides the frequency of the timing signal TS1 into n-sections and outputs this divided one as the divided frequency signal BS1 to the line memory 28. The line memory 28 stores the one-dimensional image data from the frame memory 26 based on this divided frequency signal BS1, and stores the data temporarily. Next, n-frequency divider 30*b* divides the frequency of the timing signal TS2, which follows the timing signal TS1 with a delay by a single pulse width, into n-sections, and outputs this as the divided frequency signal BS2 to the division processing circuit 34. The division processing circuit 34 reads the one-dimensional image data stored in the line memory 28, based on the divided frequency signal BS2, and generates n-combinations of the one-dimensional image data by the above-described process of referring to a table from this one-dimensional image data.

The divided image data generated as above-mentioned is cyclically stored in each of the line memories 36*a*, 36*b*, and 36*c* as a one-dimensional image data. Then, the control unit 18 switchingly controls the switching device 38 according to the timing signal TS3 which follows the timing signal TS2 with delay of a single pulse width, and sequentially provides the divided image data stored in the line memories 36*a*, 36*b*, and 36*c* to the thermal head drive unit 24.

The thermal head drive unit 24 first provides, a drive electric current based on the divided image data from the line memory 36*a*, to the plurality of heating elements 22, which constitute the thermal head 14, and forms a single pixel by performing recording on the thermal recording material S in a one-dimension direction of the direction of the arrow X. Next, the thermal head drive unit 24 subsequentially provides, a drive electric current based on the divided image data from the line memory 36*b* and the divided image data from the line memory 36*c*, to the heating element 22 resulting in forming subsequent two pixels.

In this embodiment, then, the thermal patterns generated at neighboring pixels are shifted over and then recording is performed. Additionally, the number of heating elements being activated during each of the recording times is made substantially uniform. Specifically, particularly in the case of an image such as a solid image in which recording noise is easy to be generate, the positions of the heating elements made to be heated up are dispersed in correspondence to their corresponding pixel positions (i.e., the width direction at the time of performing recording), and also, are made to be uniform to each other with respect to time (i.e., the width direction at the time of recording), as shown in FIG. 7.

Namely, as shown in FIG. 7, when dispersion-recording is to be performed from dispersion 0 to dispersion 131, control is performed so that (1) it is avoided that neighboring heating elements lie in the ON-status each time, and (2) the number of activated hearing elements 22 is kept substantially uniform (see the figures in the rightmost column in the table).

Further, in FIG. 7, the number oil pulses having a width of 32 in the horizontal direction is counted (i.e., the chart shows the number of "ON-pulses" at each recording time), and it is evident that the number of pulses lying in ON-status at each recording time is 47–49, being substantially the same number. This indicates that voltage during each of the times is little changed, and therefore, voltage drops are also small.

Additionally, as shown in FIG. 7, the number of activated pulses is 47–49, being substantially the same number, so that the number of heating elements lying in ON—status at each of the times, are mutually substantially same. Therefore, the amount of the thermal film surface layer burned-in caused by heat keeps constant, resistance (a type of frictional resistance) when the film is transferred does not change, and generation of sound (namely recording noise) when transfer is suppressed.

Note that, in the above embodiment, there is shown an example in which the thermal patterns are made to be mutually different between the neighboring pixels. However, likewise, also when the thermal patterns are made to be different between neighboring lines of image data (an odd line and an even line), the above-mentioned actions and effects can be obtained.

The above embodiments are directed to one example of the present invention. The present invention is not limited to the embodiments. Needless to say, various types of modification and improvement may be made within a scope of the present invention.

As above-mentioned, according to the present invention, in the dispersion-recording technology using a thermal head, an effect is produced such that the image recording method capable of easily preventing noise generation when recording is realized, and additionally, this can be embodied as the image recording apparatus.

More specifically, by dispersion-recording the image in a way such as shown in FIG. 7, the timing when the neighboring pixels are heated up, is shifted, and the number of pulses activated at each timing is kept substantially the same, so that a voltage drop may be suppressed and fluctuations in sticking between the recording layer and the thermal head are decreased, producing the result that the transfer of the film can be smoothed and the recording noise can be decreased.

What is claimed is:

1. An image recording apparatus comprising:

an image recording unit which records an image in a first direction;

a transfer unit which relatively transfers said image recording unit and a recording medium in a second direction normal to said first direction; and a record control unit which controls and records a single pixel using a plurality of pulses when said image is recorded, said record control unit expressing gradation for said image to be recorded using a first pulse having a larger pulse width expressing a superordination bit and a second pulse having a smaller pulse width expressing a subordination bit, said record control unit comprising:

a controller that generates a plurality of timing signals that are transmitted to respective frequency dividers to generate said plurality of pulses, wherein at least one of said frequency dividers outputs a first frequency divided signal to a switching device, and at least another of said frequency dividers outputs a second frequency divided signal to a processing circuit that generates at least one output in accordance with stored data.

2. The image recording apparatus according to claim 1, said first pulse expressing said superordination bit having said larger pulse width lying at irregular intervals applied to said single pixel.

3. The apparatus of claim 1, wherein said record control unit has activation or nonactivation operation for each of said pulses, related to a specified bit forming image data.

4. The image recording apparatus according to claim 3, said image recording unit being provided a thermal head.

5. The image recording apparatus according to claim 1, said image recording unit being provided a thermal head.

6. The apparatus of claim 1, wherein said processing circuit generates outputs to respective ones of a plurality of line memory devices, each of which generates a line memory pulse in accordance with a clocking signal received from said controller.

7. The apparatus of claim 6, wherein said line memory pulse of each of said line memory devices is input to said switching device, which selects said line memory pulse from one of said line memory devices, and forwards said selected line memory pulse to said image recording unit.

8. The image apparatus of claim 1, wherein said record control unit comprising a data storage unit that stores data indicative of the correlation between said superordination bit and said first pulse, and said subordination bit and said second pulse.

9. An image recording method of recording a single pixel forming an image using a plurality of pulses comprising the step of:

expressing gradation using a first pulse expressing a superordination bit having a larger pulse width and a second pulse expressing a subordination bit having a smaller pulse width;

generating a plurality of timing signals that are transmitted to respective frequency dividers to generate said plurality of pulses;

at least one of said frequency dividers outputting a first frequency divided signal to a switching device, and at least another of said frequency dividers outputs a second frequency divided signal to a processing circuit; and said processing circuit generating at least one output in accordance with stored data.

10. The image recording method according to claim 9, said first pulse expressing said superordination bit having said larger pulse width lying at irregular intervals applied to said single pixel.

11. The image recording method according to claim 9, further comprising the step of:

having activation or non-activation operation for each of said pulses, related to a specified bit forming image data.

12. The method of claim 11, wherein a gradation of N levels in said single pixel is expressed using fewer than N−1 pulses.

13. The method of claim 9, wherein said generating step comprises generating outputs to respective ones of a plurality of line memory devices, each generating a line memory pulse in accordance with a clocking signal received from said controller.

14. The method of claim 13, further comprising: inputting said line memory pulse of each of said line memory devices into said switching device; and said switching device selecting said line memory pulse from one of said line memory devices, and forwarding said selected line memory pulse to said image recording unit.

15. The method of claim 9, wherein thermal patterns are made to be different between at least one neighboring pixels and neighboring lines of image data.

16. The method of claim 9, wherein a gradation of N levels is expressed using fewer than N−1 pulses.

17. An image recording apparatus comprising:

an image recording unit which records an image in a first direction;

a transfer unit which relatively transfers said image recording unit and a recording medium in a second direction normal to said first direction; and a record control unit which controls and records a single pixel using a plurality of pulses when said image is recorded, said record control unit having activation or non-activation operation for each of said pulses, related to a specified bit forming image data.

wherein a pattern of generating said plurality of pulses is set to be random between the pixel positions in a horizontal direction to prevent cyclic irregularity.

18. The image recording apparatus according to claim 17, said image recording provided a thermal head.

* * * * *